US006384524B1

(12) United States Patent
Oh

(10) Patent No.: US 6,384,524 B1
(45) Date of Patent: May 7, 2002

(54) INLINE ELECTRON GUN WITH IMPROVED ASTIGMATISM FOR A CATHODE RAY TUBE

(75) Inventor: Tae-sik Oh, Pusan (KR)

(73) Assignee: Samsung SDI Co., Ltd., Youngin (KR)

( * ) Notice: Subject to any disclaimer, the term of this patent is extended or adjusted under 35 U.S.C. 154(b) by 0 days.

(21) Appl. No.: 09/425,440

(22) Filed: Oct. 22, 1999

(30) Foreign Application Priority Data

Nov. 20, 1998 (KR) ..... 98-49991

(51) Int. Cl.[7] ..... H01J 29/51

(52) U.S. Cl. ..... 313/414; 313/412; 313/432; 313/439

(58) Field of Search ..... 313/414, 412, 313/409, 421, 426, 432, 439

(56) References Cited

U.S. PATENT DOCUMENTS 3,873,879 A 3/1975 Hughes
4,388,553 A 6/1983 Chen
5,394,053 A * 2/1995 Yun ..... 313/414
5,739,630 A * 4/1998 Shirai et al. ..... 313/414
5,883,463 A * 3/1999 Kikuchi et al. ..... 313/414

* cited by examiner

*Primary Examiner*—Ashok Patel
(74) *Attorney, Agent, or Firm*—Robert E. Bushnell, Esq.

(57) ABSTRACT

An inline electron gun includes three inline cathodes arranged in a same plane, a prefocus lens and a main focus lens which includes a plurality of electrodes for converging or diverging a thermion emitted by the cathodes to form electron beams. Focus lenses include a rim or a lip at opposite ends to form a large aperture. The main focus lens may include a focus electrode, an anode electrode and a subsidiary electrode arranged between the focus electrode and the anode electrode to define a beam course of respective red, green and blue electron beams. The focus electrode has symmetrical rectangular slots in its wall to define a green aperture of the subsidiary electrode, whereby the slots decrease influence of the electric field to the electron beam passing through the green aperture so that the red, green and blue spots on the screen have a uniform vertical diameter.

20 Claims, 4 Drawing Sheets

Fig. 4 *(Prior Art)*
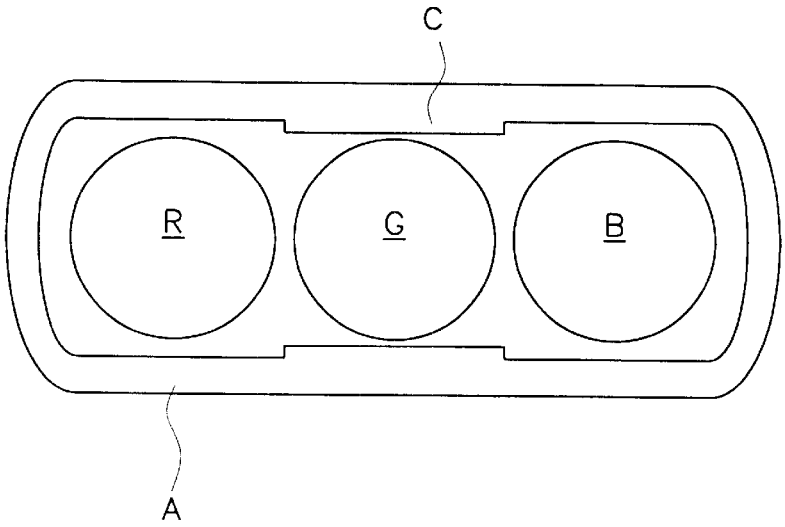
Fig. 5 *(Prior Art)*
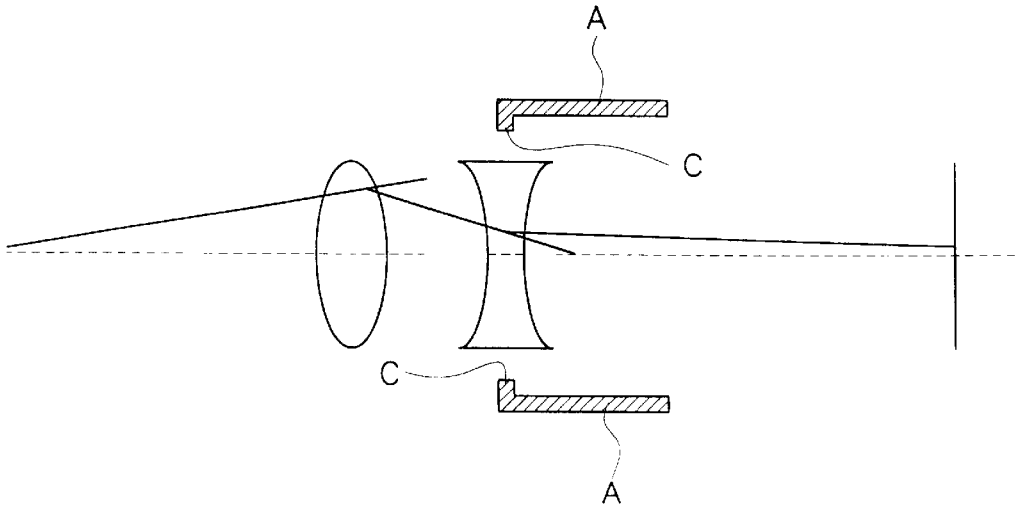

INLINE ELECTRON GUN WITH IMPROVED ASTIGMATISM FOR A CATHODE RAY TUBE

BACKGROUND OF THE INVENTION

1. Field of the Invention

The present invention relates to an inline electron gun for a cathode ray tube (CRT), and, more particularly, to an inline electron gun that is structured to improve an astigmatism in a focus lens.

2. Description of the Prior Art

A inline electron gun is arranged to form red, green and blue electron beams which passes through converging paths to a converging spot of a shadow mask or of an adjacent display screen.

Typically, a convergence of the beams is performed by an electric field which is formed by a plurality of the electrodes. A beam forming region in the electron gun includes a convergence region and a divergence region depending upon a difference in potential between adjacent electrodes. The convergence of the electron beams has an important effect on spots on the display screen. If the difference in potential is higher, the beams are more intensively converged.

However, the excessive difference in potential is not desirable in the aspect of a gradient of voltage.

U.S. Pat. No. 3,873,879 discloses a focus lens with a large diameter comprising two cup type electrodes symmetrically disposed to enlarge the electric field. It is well known that when a diameter of the focus lens is increased in the electron gun, a spherical aberration is decreased. Furthermore, when a space between the adjacent electrodes is increased, the spherical aberration is decreased because of the decreased gradient of the voltage.

However, when the space between the adjacent electrodes is more than 1.27 mm, the electrostatic field applies the electron beams to be curved. Furthermore, it is desired to consider an astigmatism in the electron gun together with the spherical aberration. The astigmatism is that, when the red, green and blue electron beams produce a circular spot on the display screen of the CRT, the vertical diameter of the green spot on the display screen is shorter than those of the red and blue spots. This is caused by the structure of the inline electron gun in which the center green electron beam is disposed asymmetrically with respect to the adjacent red and blue electron beams. To compensate for the astigmatism, controlling of the voltage applied to the electrodes of the electron gun and disposing of a magnetic element on a neck of the CRT are proposed, but these proposals are not a fundamental solution.

U.S. Pat. No. 4,388,553 discloses the compensating of the astigmatism by the construction of horizontal slots formed at an outlet side of a second accelerating electrode and a focus electrode of the electron gun. However, such proposal needs additional parts to provide two parallel strips and assembling of them into the electron gun.

Furthermore, other proposals for decreasing the astigmatism without additional parts have been tried. On the one hand, a center aperture is elongated to enlarge the vertical diameter of the green spot corresponding to the other red and blue spots. On the other hand as shown in FIG. 4, a protrusion C is formed adjacent to the center aperture G of an anode electrode A. Due to the protrusion C, the green electron beam is subject to a more intensive electromagnetic field than the adjacent red and blue electron beams and wherein the green electron beam is diverged to compensate for a decreased diameter of the green spot by the astigmatism.

However, a deformation of the center aperture to a vertical elongated one has the problem that the green spot on the display screen is distorted and the design of the elongated aperture is difficult to completely remove the astigmatism. With respect to the electrode having the protrusion C, the selection of the proper height of the protrusion C is difficult. Furthermore, when the anode electrode is subject to a minute variance of the voltage, a variance of the vertical diameter of the green spot on the display screen is considerable (see FIG. 5).

SUMMARY OF THE INVENTION

The present invention has been made in an effort to solve the above described problems.

It is an objective of the present invention to provide an inline electron gun that is structured to improve an astigmatism so that a vertical diameter of a green spot on a display screen is equalized with those of adjacent blue and red spots and the design can be easily made.

To achieve the above objective, the present invention provides an inline electron gun including three inline cathodes arranged in a same plane, a prefocus lens and a main focus lens which include a plurality of electrodes for converging or diverging a thermion emitted by the cathodes to form electron beams.

The electrodes include a control grid as a first electrode, a screen electrode or second electrode, a third electrode, a fourth electrode, a fifth electrode as a focus electrode and a sixth electrode as an anode electrode aligned from the cathodes.

The focus lenses include a rim or a lip to form a large aperture. The main focus lens may include the focus electrode, the anode electrode and a subsidiary electrode arranged between the focus electrode and the anode electrode to define a beam course of respective red, green and blue electron beams.

As a feature of the present invention, the focus electrode has symmetrical rectangular slots in its wall to define a green aperture of the subsidiary electrode, whereby the slots decrease the influence of the electric field to the electron beam passing through the green aperture so that the red, green and blue spots on the screen have a uniform vertical diameter.

BRIEF DESCRIPTION OF THE DRAWINGS

The accompanying drawings, which are incorporated in and constitute a part of the specification, illustrate an embodiment of the invention, and, together with the description, serve to explain the principles of the invention:

FIG. 4 is a front view of a conventional electron gun;

FIG. 5 shows a convergence of an electron beam in the conventional electron gun depicted in FIG. 4.

DETAILED DESCRIPTION OF PREFERRED EMBODIMENT

Reference will now be made in detail to the present preferred embodiments of the invention, an example of which is illustrated in the accompanying drawings. Wherever possible, the same reference numbers will be used throughout the drawings to refer to the same or like parts.

Figure 1:
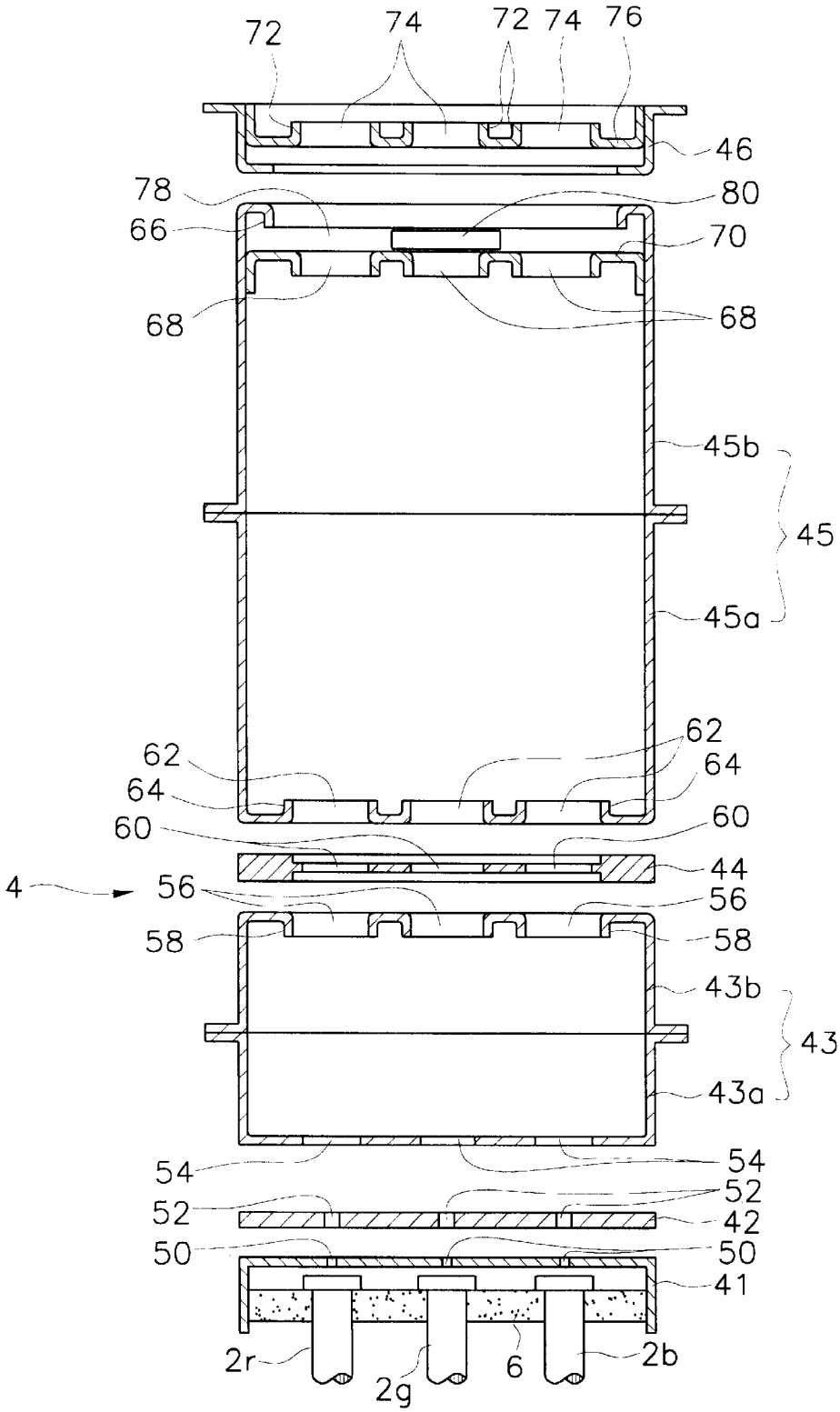
FIG. 1 is a sectional view of an electron gun in accordance with the present invention.

FIG. 1 shows an electron gun according to the present invention.

Figure 6:
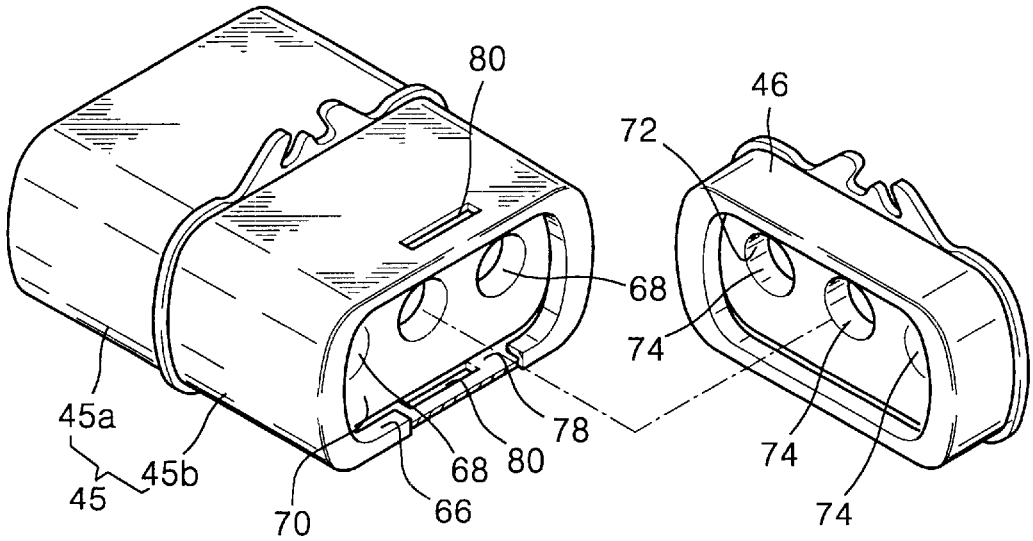
FIG. 6 is a perspective view of a focus electrode and an anode electrode of the electrode gun of FIG. 1 illustrating a plurality of slots symmetrically at the focus electrode arranged at a right angle to an aperture for an electron beam.

Referring to FIGS. 1 and 6, the electron gun includes three cathodes 2*r*, 2*g* and 2*b* for emitting thermions corresponding to red, green and blue colors, and a six electrode assembly 4 arranged uniformly by means of two glass beads (not shown).

The electrode assembly 4 includes a control grid 41 as a first electrode, a screen or second electrode 42, a third electrode 43, a fourth electrode 44, a fifth electrode 45 as a focus electrode and a sixth electrode 46 as an anode electrode aligned from the cathodes 2*r*, 2*g* and 2*b*.

The three cathodes 2*r*, 2*g* and 2*b* are spaced and mounted at the front side of the control grid 41 by means of a heat resistance material 6 such as ceramic.

The third electrode 43 includes a first cup member 43*a* and a second cup member 43*b* such that respective opening ends are integrally secured to each other, and the fifth electrode 45 also includes a first cup member 45*a* and a second cup member 45*b* secured thereto in the same manner as in the third electrode 43.

Apertures 50 of the control grid 41, apertures 52 of the screen electrode 42 and apertures 54 formed at the first cup member 43*a* of the third electrode 43 are positioned in alignment with each other to provide a beam forming region, thereby causing the thermions emitted by the cathodes 2*r*, 2*g* and 2*b* to form electron beams.

As well known, the cathodes 2*r*, 2*g* and 2*b* include a heater (not shown in figures) therein, respectively and a thermion emission material is positioned on respective surfaces of the cathodes facing the control grid 41.

Apertures 56, which are defined by three lips 58 inwardly curved, in the second cup member 43*b* of the third electrode 43 form a prefocus lens with a large diameter together with apertures 60 of the fourth electrode 44 and apertures 62, which are defined by lips 64, of the first cup member 45*a* of the fifth electrode 45.

The fourth electrode 44 is formed by a plate type electrode and a peripheral portion of the apertures 60 is deep-drawn.

The second cup member 45*b* of the fifth electrode 45 forms a focus electrode, forming a main focus lens together with an anode electrode 46. A free end of the second cup member 45*b* of the fifth electrode 45 is inwardly deep-drawn to form a rim 66, in which a subsidiary electrode 70 is mounted having apertures 68 through which the red, green and blue electron beams pass. The sixth electrode 46 is similarly provided with a subsidiary electrode 76 which has three apertures 74 defined by lips 72 and the subsidiary electrode 76 being symmetrized with the subsidiary electrode 70 to form the main focus lens with a large diameter.

A longitudinal side wall 78 including straight wall sections 78*a* and curved wall sections 78*b* transverse to a planar paths of the electron beams of the second cup member 45*b* of the fifth electrode 45 is opened at straight wall sections 78*a* by two opposite or opposing slots 80 formed between the rim 66 and the subsidiary electrode 70, which is the feature of the present invention.

Figure 2:
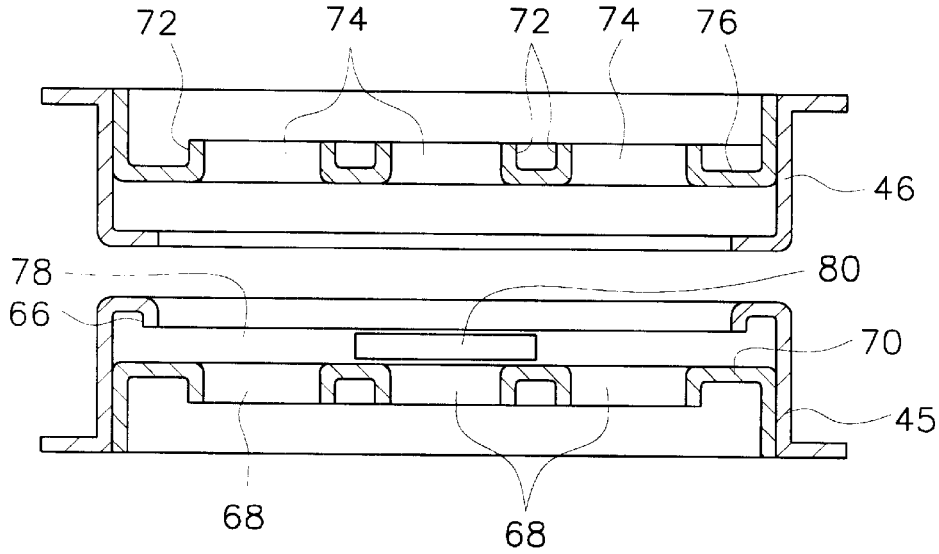
FIG. 2 shows an equipotential distribution of an electrode in the electron gun in accordance with the present invention.

FIGS. 2 and 6 show specifically the shape and position of the slots 80.

The slots 80 of a rectangular shape in the embodiment are formed at the longitudinal side wall 78 in respective straight wall sections 78*a* of the fifth electrode 45 so as to influence a vertical direction of the green electron beam which passes through the center aperture 68.

A process for forming the slots 80 at the second cup member 45*b* is simply performed by composite punching together with pressing of the fifth electrode 45. The slots 80 are simple in a design so that it is easy to manufacture the electrode and to maintain its precision regardless of a variance of voltage.

That is, referring to FIG. 1, the electron beams emitted from the three cathodes 2*r*, 2*g* and 2*b* are converged as coming into the prefocus lens including the apertures 56 of the second cup member 43*b* of the third electrode 43, the apertures 60 of the fourth electrode 44 and the apertures 62 of first cup member 45*a* of the fifth electrode 45 and are diverged as passing through the prefocus lens.

The diverged electron beams passed through the prefocus lens are again converged and diverged by the main focus lens including the fifth electrode 45 including the subsidiary electrode 70 including the apertures 68 and the sixth electrode 46 including the subsidiary electrode 76 including apertures 74. At this time, a center green electron beam is relatively weakly converged by the slots 80 formed at the second cup member 45*b* of the fifth electrode 45.

Figure 3:
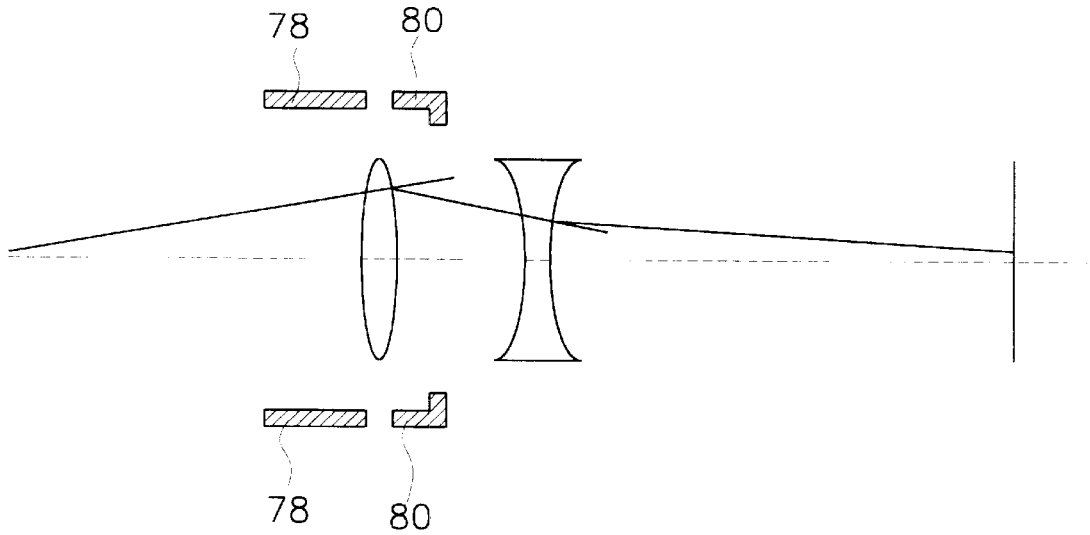
FIG. 3 shows a convergence of an electron beam in the electron gun in accordance with the present invention.

That is, as shown in FIG. 3, a relatively weakened electric field is formed at an inlet side of the center aperture 68 of the subsidiary electrode 70 and vertically influences the center aperture 68, with the result that a vertical convergence of the green electron beam passing through the center aperture 68 is relatively weakened as to those of the red and blue beams to cause the astigmatism in the three beams to be compensated, and whereby the red, green and blue spots with a uniform vertical diameter are provided on the display screen.

The slots 80 may be symmetrically formed at the end portion of the cup member 45*b* adjacent to the center aperture 68, but a shape of the slots 80 may be properly changed corresponding to a desired spot on the display screen. Also, the opposite slots 80 may have a different shape from each other to obtain the desired astigmatism correction for the center electron beam. Undoubtedly, the present invention may be adopted to the CRT together with a conventional astigmatism correction method.

In accordance with the present invention, the astigmatism of the center electron beam caused at the main focus lens can be conveniently corrected by forming of the slots at the second cup member of the fifth electrode. The slots can be simply formed at the fifth electrode working process without additional parts and fitting steps. Furthermore, the fifth electrode working process and maintaining of the precision of the electrode can be easily performed.

What is claimed is:

1. An inline electron gun for a cathode ray tube, comprising:

a plurality of inline cathodes for emitting thermions for corresponding electron beams;

a prefocus lens comprising a plurality of electrodes and a plurality of apertures for selectively converging and diverging the thermions emitted from the plurality of the cathodes to form the corresponding electron beams; and a focus electrode for receiving the corresponding electron beams from the prefocus lens, the focus electrode comprising straight wall sections parallel to coplanar paths of the corresponding electron beams and opposing slots respectively in the straight wall sections in relation to a green aperture of a plurality of apertures of the focus electrode, the opposing slots for decreasing an influence of an electric field to an electron beam passing through the green aperture to improve an astigmatism.

2. The inline electron gun of claim 1, further comprised of the opposing slots being of a rectangular shape of which a longer side of each of the opposing slots is arranged at a right angle to the green aperture for a green electron beam.

3. The inline electron gun of claim 1, further comprised of the opposing slots being symmetrically disposed at the focus electrode.

4. The inline electron gun of claim 2, further comprised of the opposing slots being symmetrically disposed at the focus electrode.

5. The inline electron gun of claim 1, further comprised of the plurality of inline cathodes being three inline cathodes.

6. An inline electron gun for generating and directing a plurality of electron beams toward a screen of a cathode ray tube, comprising:

a main focus lens comprising a focus electrode and an anode electrode, the focus electrode comprising straight wall sections parallel to coplanar paths of the plurality of electron beams and curved wall sections transverse to the coplanar paths of the plurality of electron beams, with slots being respectively provided in each of the straight wall sections.

7. The inline electron gun of claim 6, further comprised of the slots being rectangular in shape.

8. The inline electron gun of claim 7, further comprised of the slots being symmetrically provided in the straight wall sections with respect to the coplanar paths of the plurality of electron beams.

9. The inline electron gun of claim 6, further comprised of the slots being symmetrically provided in the straight wall sections with respect to the coplanar paths of the plurality of electron beams.

10. The inline electron gun of claim 6, further comprised of the slots being of a rectangular shape of which a longer side of each slot is arranged at a right angle to an aperture for a green electron beam.

11. The inline electron gun of claim 10, further comprised of the slots being symmetrically disposed at the focus electrode.

12. The inline electron gun of claim 6, further comprised of the slots being symmetrically disposed at the focus electrode.

13. The inline electron gun of claim 6, further comprised of the slots being respectively arranged in opposing relation in the straight wall sections.

14. An inline electron gun for generating and directing a plurality of electron beams toward a screen of a cathode ray tube, comprising:

a main focus lens comprising a focus electrode and an anode electrode, the focus electrode comprising wall sections parallel to coplanar paths of the plurality of electron beams and slots respectively provided in the wall sections.

15. The inline electron gun of claim 14, further comprised of the slots being rectangular in shape.

16. The inline electron gun of claim 15, further comprised of the slots being symmetrically provided in the wall sections with respect to the coplanar paths of the plurality of electron beams.

17. The inline electron gun of claim 14, further comprised of the slots being of a rectangular shape of which a longer side of each slot is arranged at a right angle to an aperture of the focus electrode for a green electron beam.

18. The inline electron gun of claim 17, further comprised of the slots being symmetrically disposed at the focus electrode.

19. The inline electron gun of claim 14, further comprised of the slots being symmetrically disposed at the focus electrode.

20. The inline electron gun of claim 14, further comprised of the slots being arranged in opposing relation in the wall sections.

* * * * *